US010072433B2

(12) United States Patent
Dilley

(10) Patent No.: US 10,072,433 B2
(45) Date of Patent: Sep. 11, 2018

(54) SWIMMING LANE MARKER

(71) Applicant: Gary Dilley, Raleigh, NC (US)

(72) Inventor: Gary Dilley, Raleigh, NC (US)

( * ) Notice: Subject to any disclaimer, the term of this patent is extended or adjusted under 35 U.S.C. 154(b) by 305 days.

(21) Appl. No.: 14/480,212

(22) Filed: Sep. 8, 2014

(65) Prior Publication Data

US 2015/0067957 A1 Mar. 12, 2015

Related U.S. Application Data

(60) Provisional application No. 61/874,701, filed on Sep. 6, 2013.

(51) Int. Cl.
*E04H 4/14* (2006.01)
*A63B 69/12* (2006.01)

(52) U.S. Cl.
CPC ..... *E04H 4/143* (2013.01); *A63B 69/12* (2013.01); *A63B 2208/03* (2013.01); *A63B 2244/20* (2013.01)

(58) Field of Classification Search
CPC ..... E04H 4/143; E04H 4/14; A63B 69/12; A63B 2208/03; A63B 2244/20
USPC ..... 4/505, 496; 482/55
See application file for complete search history.

(56) References Cited

U.S. PATENT DOCUMENTS 2,117,982 A * 5/1938 Prince, Jr. ..... E04H 4/143 119/422
3,119,610 A * 1/1964 Clinton ..... A63B 71/0686 434/254
3,498,246 A * 3/1970 Kiefer ..... E04H 4/143 114/267
3,540,063 A * 11/1970 Stanwood ..... E04H 4/14 4/497
3,786,521 A * 1/1974 Walket ..... E04H 4/143 4/497
4,122,560 A * 10/1978 Baker ..... E04H 4/143 24/71 ST
4,149,712 A * 4/1979 Murphy ..... A63B 1/00 4/496
4,693,570 A 9/1987 Kryder
4,948,118 A * 8/1990 Miraglia ..... A61H 3/008 104/62
5,271,106 A 12/1993 McClish et al.
5,391,080 A 2/1995 Bernacki et al.
(Continued)

FOREIGN PATENT DOCUMENTS

CN 201180381 Y 1/2009
DE 3529467 A1 3/1986
(Continued)

OTHER PUBLICATIONS

Yahoo! Answers, Moving straight in backstroke swimming ?, Jun. 3, 2013, http://answers.yahoo.com/question/index?qid=20110326230824AAwlgRb.

*Primary Examiner* — J. Casimer Jacyna
(74) *Attorney, Agent, or Firm* — Michael G. Johnston; Moore & Van Allen PLLC

(57) ABSTRACT

A marker is provided for a swimming lane extending a length of a pool. The pool includes sidewalls connecting end walls for defining a swimming area holding water. The marker comprises a line and means for suspending the line over the water in the swimming area. The line provides a visual indication of the position of the swimming lane in the swimming area.

15 Claims, 3 Drawing Sheets

(56) References Cited

U.S. PATENT DOCUMENTS

| | | | | |
|---|---|---|---|---|
| 6,055,683 | A * | 5/2000 | Komer | E04H 4/143 4/496 |
| 6,079,059 | A | 6/2000 | Girerd | |
| 6,421,962 | B2 | 7/2002 | McNamara | |
| 2007/0105081 | A1 | 5/2007 | Valle | |
| 2008/0057806 | A1 | 3/2008 | Blumberg | |

FOREIGN PATENT DOCUMENTS

| | | | |
|---|---|---|---|
| DE | 10100457 | C1 | 10/2002 |
| FR | 2789797 | A1 | 8/2000 |
| FR | 2953730 | A3 | 6/2011 |
| JP | 01305974 | * | 12/1989 |

* cited by examiner

SWIMMING LANE MARKER

CROSS-REFERENCES

This application is related to U.S. provisional application No. 61/874,701, filed Sep. 6, 2013, entitled "Swimming Lane Marker", naming Gary Dilley as the inventor. The contents of the provisional application are incorporated herein by reference in their entirety, and the benefit of the filing date of the provisional application is hereby claimed for all purposes that are legally served by such claim for the benefit of the filing date.

BACKGROUND

A marker is shown and described for marking a lane of a swimming pool and, more particularly, for marking the swimming lane for a swimmer using a backstroke for allowing the swimmer to identify his position in the pool.

Floating swimming lane markers segregate a swimming pool into discreet swimming lanes defined by a pair of floating lane markers or one floating lane marker and a sidewall of the pool. Swimmers typically swim between the lane markers to prevent the swimmers from running into each other. Conventional lane markers float on the water and are disposed on either side of a line painted on the bottom of the pool. The swimmers use the line and the lane markers to align themselves within the swimming lane while swimming.

Swimmers using a backstroke cannot rely on visual input from the lane markers to align themselves within a swimming lane. Backstroke swimmers thus find it difficult to swim laps without constantly adjusting their position in the swimming lane by physically touching the lane markers on either side of the swimming lane.

For the foregoing reason, there is a need for a swimming lane marker or marker system that allows a swimmer using the backstroke to be visually aware of his position in a swimming lane.

SUMMARY

A marker is provided for a swimming lane extending a length of a pool. The pool includes sidewalls connecting end walls for defining a swimming area holding water. The marker comprises a line and means for suspending the line over the water in the swimming area. The line provides a visual indication of the position of the swimming lane in the swimming area.

DESCRIPTION

Certain terminology is used herein for convenience only and is not to be taken as a limitation on the invention. For example, words such as "upper," "lower," "left," "right," "horizontal," "vertical," "upward," and "downward" merely describe the configuration shown in the FIGS. Indeed, the components may be oriented in any direction and the terminology, therefore, should be understood as encompassing such variations unless specified otherwise.

Figure 1:
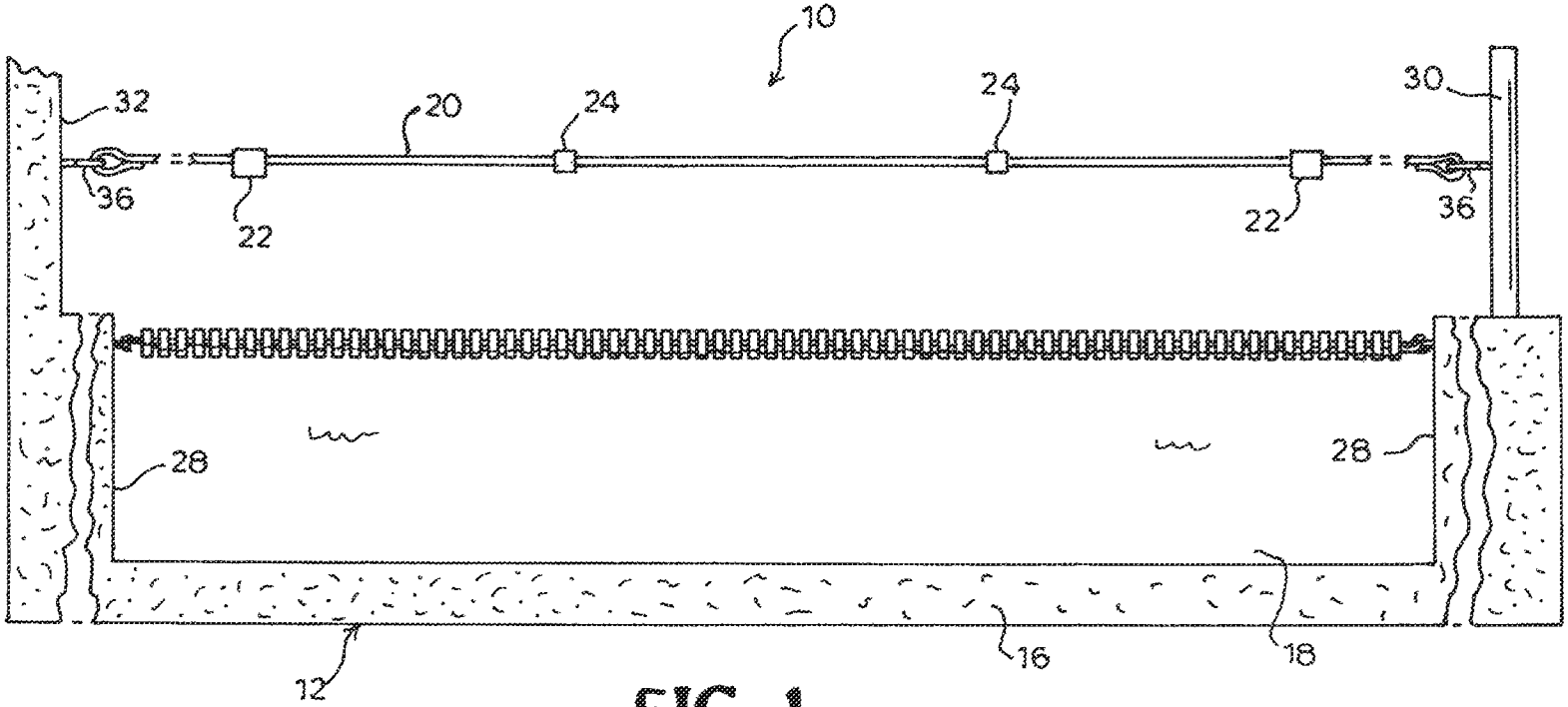
FIG. 1 is a schematic side view of a pool with the end walls of the pool broken away and showing an embodiment of a swimming lane marker.
Figure 2:
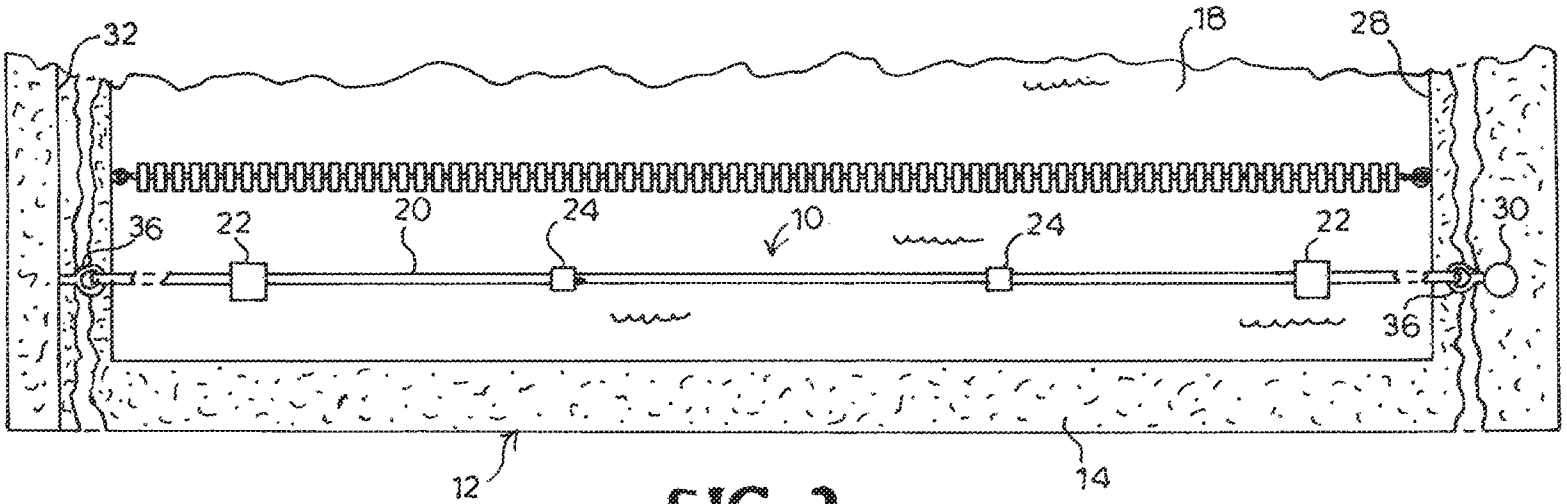
FIG. 2 is a schematic top view of the pool and the swimming lane marker as shown in FIG. 1.

Referring now to the FIGS. 1 and 2, wherein like reference numerals designate corresponding or similar elements throughout the several views, a typical swimming pool 12 includes a continuous sidewall 14 and a bottom wall 16. The sidewall 14 and the bottom wall 16 cooperate to define a cavity that is substantially filled with water 18 to define a swimming area. A pair of conventional floating lane markers, one of which is shown, are conventionally disposed across a longitudinal expanse of the swimming pool 12.

An embodiment of a lane marker is shown for use by a swimmer using the backstroke and generally designated at 10. The lane marker 10 comprises a longitudinal strap 20, or cable, positioned above the water surface and a plurality of indicia 22, 24 attached to the strap 20. The strap 20 may be fabricated from a generally lightweight textile material, plastic or rubber, but also may be fabricated from other suitable materials that are known in the art.

The strap 20 extends over the pool 12 between two walls 32 adjacent to the swimming pool 12. The ends of the strap 20 are connected to a pole 30 at one end and to a wall 32 at the other end. An attachment member or frame assembly (not shown) may be provided on the pole 30 or the wall 32 for securing the ends of the strap 20. It is understood that the strap 20 may be connected to two poles 30 or the walls 32 at each end of the strap 20.

The strap 20 is suspended a sufficient distance above the water surface so as to not interfere with a swimmer. For example, the strap 20 may be suspended ten feet above the water surface to accommodate swimmers jumping off of starting blocks. Alternatively, the lane marker 10 may be suspended from the ceiling by connecting elements (not shown) between the ceiling and the strap 20. It is understood that the lane marker 10 may be disposed in other configurations with respect to the pool 12 and that the swimming area of the pool does not have to be substantially rectangular as shown in the drawings.

The lane marker 10 may be selectively disconnected from the pole 30, walls 32 or ceiling and removed and stored, for example, by winding on a spool (not shown). The spool may be operatively connected to a winch which, in one embodiment, is powered and in turn connected to a winch controller. Removal and storage of the strap 20 allows the pool 12 to be selectively configured for lap swimming.

The indicia on the lane marker 10 comprise a 2.5 meter marker 22 and a 12.5 yard marker 24 as measured from each end wall 28 of the pool 12. The 2.5 meter marker 22 functions as an end-of-lane marker and indicates for a swimmer using the backstroke when the swimmer is approaching each end wall 28 of the pool 12. The swimmer can then anticipate contact with the pad or execute a flip turn. The 12.5 yard marker indicates for a swimmer using the backstroke when the swimmer must be on the surface of the water 18. It is understood that there would only be one 12.5 yard marker at the center of the lane marker 10 when used for a 25 yard pool.

Figure 3:
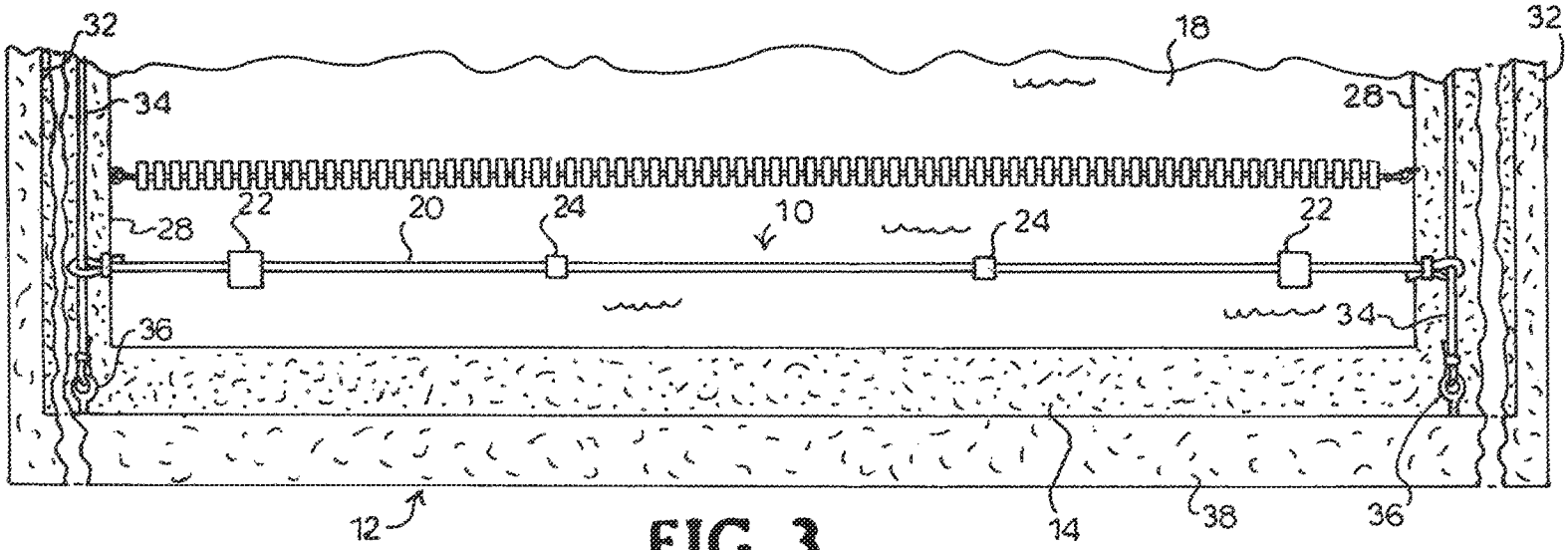
FIG. 3 is a schematic top view of the pool and the swimming lane marker as shown in FIG. 1 suspended from a line spanning between sidewalls of the pool.

Another embodiment of means for suspending the strap is shown in FIG. 3. A second strap 34 or line is suspended between an eye hook 36 in the walls 38 along each side of the pool. The ends of the strap 20 are secured to the second strap 34 over the swimming lane.

In another embodiment of the lane marker, laser lamps (not shown), or other light lamps, are arranged on, or adjacent to the perimeter walls, of the swimming pool 12. The laser lamps may comprise a main unit with a transmitter for transmitting laser light and a receiver.

Subsidiary units are selectively placed around the pool 12 for reflecting the laser light. The subsidiary units include mirrors for reflecting the laser light back to the receiver in the main unit for defining a beam of light. The main unit and the subsidiary units are positioned such that the path of the laser beam defines a swimming lane marker over the pool. An electronic control unit is provided for controlling the light system for the lane marker.

In use, the strap 20 or the beam of light extends over the swimming pool 12 providing a lane marker 10 for the swimmer using the backstroke. The indicia 22, 24 provide location information to the swimmer, particularly as to the location of the end walls 28 for the swimming lane. In both embodiments, the lane marker 10 can be easily installed and selectively removed from a swimming pool when not in use.

It is understood that the embodiments of the lane marker as described herein comply with all known rules and regulations of competitive swimming.

Although the swimming lane marker has been shown and described in considerable detail with respect to only a few exemplary embodiments thereof, it should be understood by those skilled in the art that I do not intend to limit the lane marker to the embodiments since various modifications, omissions and additions may be made to the disclosed embodiments without materially departing from the novel teachings and advantages, particularly in light of the foregoing teachings. Accordingly, I intend to cover all such modifications, omission, additions and equivalents as may be included within the spirit and scope of the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. An overhead marker for use as a visual aid by a swimmer using a backstroke in a pool, the pool including sidewalls connecting end walls for defining a swimming area holding water, and a swimming lane defined by at least at least one lane marker extending the length of the pool and floating in the water between the end walls, the overhead marker comprising:

a line;

means for suspending the line above the surface of the water over the swimming area a sufficient distance so as not to interfere with the swimmer; and stationary indicia on the line for providing a visual indication of the relative position of the line along the length of the swimming lane, wherein the line provides for the swimmer a visual indication of position relative to the swimming lane in the swimming area.

2. The overhead marker as recited in claim 1, wherein the line is formed from a selected metal, textile, plastic, rubber, or a combination thereof.

3. The overhead marker as recited in claim 1, wherein the indicia is provided 2.5 meters from each end wall.

4. The overhead marker as recited in claim 1, wherein the indicia is provided 12.5 meters from each end wall.

5. The marker as recited in claim 1, wherein the suspending means comprises a pole adapted to be disposed adjacent each end wall for securing the ends of the line.

6. The overhead marker as recited in claim 1, wherein the suspending means comprises a means adapted for securing the ends of the line to each end wall.

7. The marker as recited in claim 1, wherein the suspending means comprises a means adapted for securing the ends of the line to a ceiling above the swimming area.

8. A pool for use by a swimmer using a backstroke, the pool comprising:

a pair of opposed end walls;

sidewalls connecting the end walls for defining a swimming area for holding water;

a lane marker extending a length of the pool and floating in the water between the end walls, the floating lane marker and one of the sidewalls or another floating lane marker defining a swimming lane;

a line for use as a visual aid by the swimmer;

means for suspending the line above the surface of the water over the swimming area a sufficient distance so as not to interfere with the swimmer; and stationary indicia on the line for providing a visual indication of the relative position of the line along the length of the swimming lane, wherein the line provides for the swimmer a visual indication of position relative to the swimming lane in the swimming area.

9. The pool as recited in claim 8, wherein the line is formed from a selected metal, textile, plastic, rubber, or a combination thereof.

10. The pool as recited in claim 8, wherein the indicia is provided 2.5 meters from each end wall.

11. The pool as recited in claim 8, wherein the indicia is provided 12.5 from each end wall.

12. The pool as recited in claim 8, wherein the suspending means comprises a pole disposed adjacent each end wall for securing the ends of the line.

13. The pool as recited in claim 8, wherein the suspending means comprises means for securing the ends of the line to each end wall.

14. The pool as recited in claim 8, wherein the suspending means comprises means for securing the ends of the line to a ceiling above the swimming area.

15. The pool as recited in claim 8, further comprising a second suspended line extending between the sidewalls of the pool, wherein the suspending means comprises means for securing the ends of the line to the second suspended line.

* * * * *